US006338217B1

(12) United States Patent
Viani

(10) Patent No.: US 6,338,217 B1
(45) Date of Patent: Jan. 15, 2002

(54) FIRING PIN LOCKING SYSTEM

(76) Inventor: Arthur Viani, 12219 SW. 131 Ave., Miami, FL (US) 33186

( * ) Notice: Subject to any disclaimer, the term of this patent is extended or adjusted under 35 U.S.C. 154(b) by 0 days.

(21) Appl. No.: 09/662,578

(22) Filed: Sep. 15, 2000

(51) Int. Cl.[7] ..... F41A 17/02
(52) U.S. Cl. ..... 42/70.08; 42/70.11
(58) Field of Search ..... 42/1.01, 70.01, 42/70.08, 70.11; 89/148, 174, 18

(56) References Cited

U.S. PATENT DOCUMENTS

| | | | | | |
|---|---|---|---|---|---|
| 1,842,847 | A | * | 1/1932 | Stange | 42/70.01 |
| 4,014,123 | A | * | 3/1977 | Williams | 42/1 LP |
| 4,512,099 | A | * | 4/1985 | Mathew | 42/1 LP |
| 4,726,136 | A | * | 2/1988 | Dornaus et al. | 42/70.08 |
| 5,913,666 | A | * | 6/1999 | Perkins | 42/70.11 |
| 6,240,670 | B1 | * | 6/2001 | Findlay | 42/70.08 |

FOREIGN PATENT DOCUMENTS

| | | | | | |
|---|---|---|---|---|---|
| GB | 2215822 | A | * | 9/1989 | F41C/17/08 |

* cited by examiner

*Primary Examiner*—Michael J. Carone
*Assistant Examiner*—Gabriel S Sukman
(74) *Attorney, Agent, or Firm*—J. Sanchelima; A. Bordas

(57) ABSTRACT

A firing pin locking mechanism that can be used on firearms. Controlled by a key, the internal locking device blocks all movement of the firing pin assembly striker, rendering the firing arm from discharging. The mechanism primarily comprises a spacer sleeve and a slide cover key plate. Utilizing the key, the authorized user has the ability to set the firearm in a "unlocked" or "locked" mode, even while in a holster. The internal locking mechanism is utilized as a means to prevent the movement of a firearm's firing pin assembly when activated by the trigger mechanism, regardless of the status of the firearm. The present invention is primarily utilized with semi-automatic firearms that have an enclosed striker assembly.

6 Claims, 3 Drawing Sheets

FIRING PIN LOCKING SYSTEM

BACKGROUND OF THE INVENTION

1. Field of the Invention

The present invention relates to a turn-key locking mechanism for weapons, and more particularly, to an internal locking mechanism for firearms.

2. Description of the Related Art

Weapons and firearms are very dangerous. Many firearm locking mechanisms have been introduced to reduce the possibility of injury when unauthorized users discharge them, especially children. Presently, most firearms are manufactured with built-in safety mechanisms for triggers and firing pin assembles, as well as mechanisms to prevent discharge in the event of an accidental drop. However, there is a need to place firearms in an "unlocked" or "locked" mode notwithstanding the firearm in cocked or fired position. This would allow the authorized user to activate the firearm to "unlock" or deactivate the firearm to "locked" mode, even while set in a holster. There is a need for a practical and inexpensive assembly that can be incorporated into firearms without major structural changes to lock a firearm irrespective of the firearm status.

There are no similar internal locking mechanisms to the best of applicant's knowledge, that may be utilized to lock a firearm regardless of the firearm status, with a key that does not require movement of a firearm slide.

SUMMARY OF THE INVENTION

It is one of the main objects of the present invention to provide an internal locking mechanism for firearms to lock the firing mechanism, regardless of the firearm status.

It is another object of the present invention to provide a key to set the firearm in a "unlocked" or "locked" mode even if the firearm is secured in a holster.

It is still another object of this invention to provide a locking mechanism for firearms that includes a key, an internal locking device and a slide cover key plate.

It is yet another object of this invention to provide a locking mechanism for firearms in which the internal locking mechanism is utilized as a means to prevent the movement of a firearm firing pin assembly when activated by the trigger mechanism, regardless of the firearm status.

It is still another object of the present invention to provide an internal locking mechanism utilized with semi-automatic firearms that have an enclosed striker assembly.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
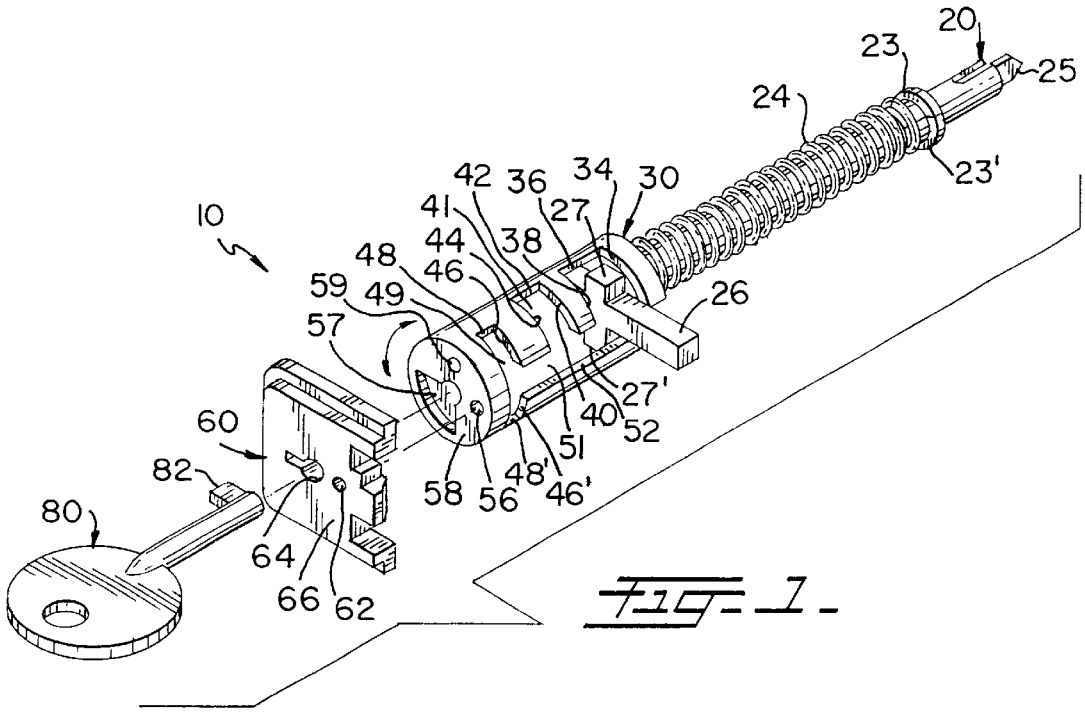
FIG. 1 represents an exploded view of the internal locking mechanism in the unlocked mode.

Referring now to the drawings, where the present invention is generally referred to with numeral 10, it can be observed that it basically includes spacer sleeve assembly 30, key plate assembly 60, and key 80.

As seen in FIG. 1, firing pin assembly 20 slidably journals within longitudinal channel 51 of spacer sleeve assembly 30. Longitudinal channel 51 has fired notch 35, seen in FIG. 3, cocked notch 41, and assembly notch 49.

Fired notch 35 is defined by side edge 36 establishing a parallel and spaced apart relationship between front edge 34 and rear edge 38 in the preferred embodiment. While firing leg 26 fills fired notch 35, firing leg 26 is biased against front edge 34 due to the spring force exerted by spring 24 against edge 32, seen in FIG. 3. Cocked notch 41 is defined by side edge 42 establishing a parallel and spaced apart relationship between front edge 40 and rear edge 44 in the preferred embodiment. While firing leg 26 fills cocked notch 41, firing leg 26 is biased against front edge 40 due to the spring force exerted by spring 24. Assembly notch 49 allows for assembly of firing pin assembly 20 onto spacer sleeve assembly 30. To insert firing pin assembly 20 within spacer sleeve assembly 30, end 25 of firing pin assembly 20 is inserted at a predetermined angle along longitudinal channel 51 of spacer sleeve assembly 30 without spring 24 and spring cups 23 and 23'. Ends 27 and 27' are respectively aligned with assembly notch 49, defined by side edges 48 and 48' establishing a parallel and spaced apart relationship between front edges 46 and 46' respectively and rear edge 50 in the preferred embodiment, seen in FIG. 3. Once received by spacer sleeve assembly 30, firing pin assembly leg 26 is slid against front edge 34 where spring 24 is placed over end 25 and retained by spring cups 23 and 23' against stopper surface 22, seen in FIG. 3.

Cylindrical spacer sleeve assembly 30 is manufactured from a durable material such as stainless steel, or a material of similar characteristics.

Figure 2A:
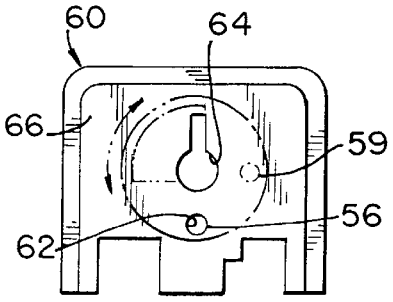
FIG. 2*a* shows an elevational view of the slide cover key plate indicating the firearm is in the unlocked mode.
Figure 2B:
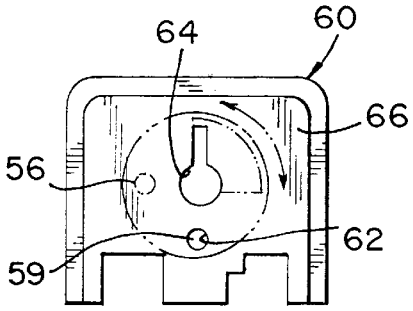
FIG. 2*b* shows an elevational view of the slide cover key plate indicating the firearm is in locked mode.
Figure 2C:
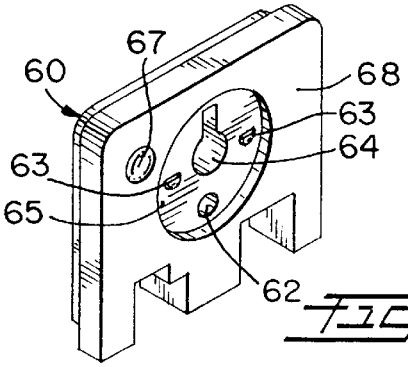
FIG. 2*c* shows an elevational view of the rear side of the slide cover key plate.

Key plate assembly 60 has exterior face 66 and interior face 68, seen in FIG. 2*c*. Key hole 64 allows access for an authorized user to trespass key plate assembly 60 with key 80. Key end 82 cooperatively fits into recess 57 of rear exterior surface 58. Through hole 62, provides notice when indicator 56 is properly aligned, indicating that the firearm is ready to discharge, as depicted in FIG. 2*a*. Additionally, through hole 62, provides notice when indicator 59 is properly aligned, indicating that the firearm is locked and will not discharge, as depicted in FIG. 2*b*.

While in the unlocked mode, as presently depicted, firing leg 26 slidably journals within spacer sleeve assembly 30 biased against longitudinal edge 52. During operation of the firearm, firing pin leg 26 slidably journals along longitudinal channel 51, thus cycling between front edge 34 after the firearm is discharged to a predetermined distance approaching rear edge 44 when cocked.

Figure 3:
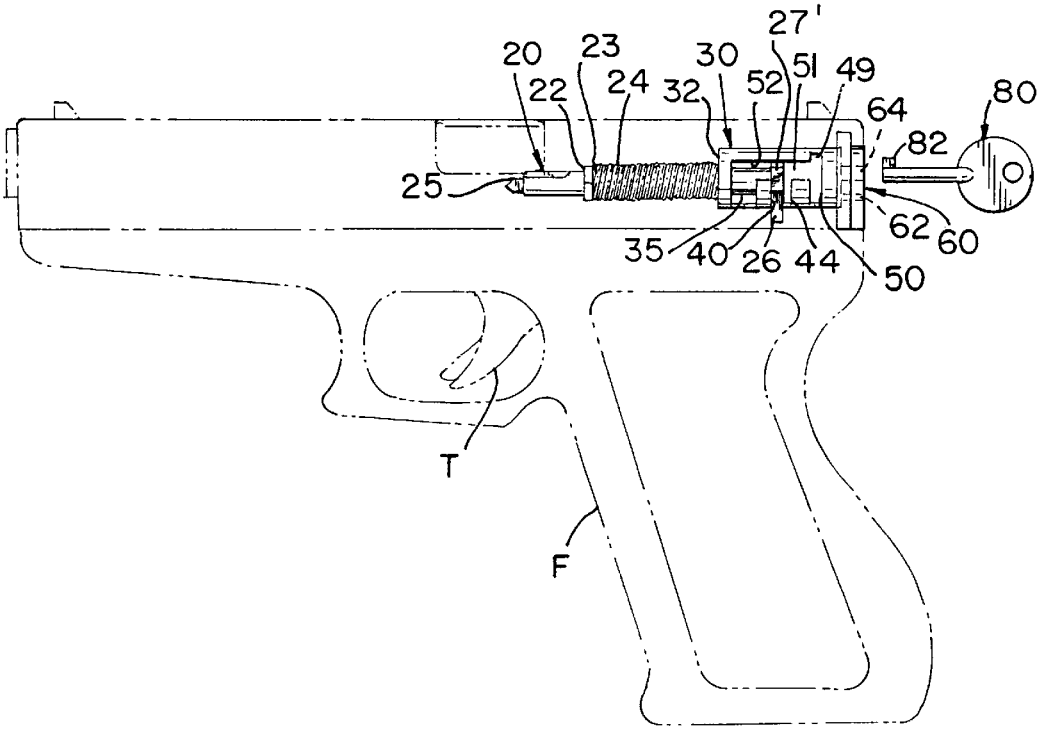
FIG. 3 illustrates an elevational view of a firearm in phantom showing the present invention in the cocked and locked position.

Seen in FIG. 2*a* is a representation of slide cover key plate assembly 60 in the unlocked mode, as represented in FIG. 1. Indicator 56, seen through through-hole 62 is of sufficient contrast to exterior face 66, to allow an authorized user to visually determine that firearm F, seen in FIG. 3, is ready to discharge. Key hole 64 allows access of key 80, shown in FIG. 1.

Seen in FIG. 2*b* is a representation of slide cover key plate assembly 60 in the locked mode, as represented in FIG. 3. Indicator 59, seen through through-hole 62 is of sufficient contrast to exterior face 66, to allow an authorized user to visually determine that firearm F, seen in FIG. 3, is locked and will not discharge. Key hole 64 allows access of key 80, shown in FIG. 1.

Seen in FIG. 2*c* is a representation of the rear side of key plate assembly 60. Interior face 68 has recess 65 shaped to cooperatively receive rear exterior surface 58 of spacer sleeve assembly 30, seen in FIG. 1. Recess 65 has protrusions 63 axially mounted thereon having mating cooperative characteristics with recess 57 to provide notice to the user by way of a slight resistance when the user rotates spacer sleeve assembly 30 selectively from an unlocked mode, as seen in FIG. 2*a,* to a cocked and locked or fired and locked mode, as seen in FIG. 2*b,* and vice-a-versa. Firearm F, seen in FIG. 3, has a protrusion, not seen, that aligns with recess 67 for additional key plate assembly 60 stability.

As seen in FIG. 3, firearm F is in the cocked and locked position. An authorized user utilizes key 80, inserting it into key hole 64 of key plate assembly 60. Key 80 is shaped to cooperatively fit into recess 57, seen in FIG. 1, of spacer sleeve assembly 30. The user inserts key 80, then turns in a clockwise direction, thereby rotating spacer sleeve assembly 30 to a locked mode position wherefore firing pin assembly leg 26 rests in cocked notch 41, upon side edge 42, seen in FIG. 1, between front edge 40 and rear edge 44, thereby preventing the movement of firing pin assembly 20 when activated by trigger T of firearm F. To remove key 80, seen in FIG. 1, the user turns the key in a counter-clockwise direction until key end 82 is aligned with key hole 64 and removed. The user may acknowledge the locked position of firearm F, by viewing indicator 59 through through-hole 62 as seen in FIG. 2*b*.

When firearm F is in the unlocked mode, firing leg 26 slidably journals within spacer sleeve assembly 30 along longitudinal channel 51, biased against longitudinal edge 52. To place in the unlocked mode, the user inserts key 80, then turns in a counter-clockwise direction, thereby rotating spacer sleeve assembly 30 to an unlocked mode position, thereby allowing for the movement of firing pin assembly 20 when activated by trigger T of firearm F. To remove key 80, seen in FIG. 1, the user turns the key in a clockwise direction until key end 82 is aligned with key hole 64 and removed. The user may acknowledge the unlocked position of firearm F, by viewing indicator 56 through through-hole 62 as seen in FIG. 2*a*.

Firearm F may be of any variety of semi-automatic firearms that have an enclosed striker assembly. Such a firearm may be a "GLOCK", without limitation to this specific brand.

Figure 4:
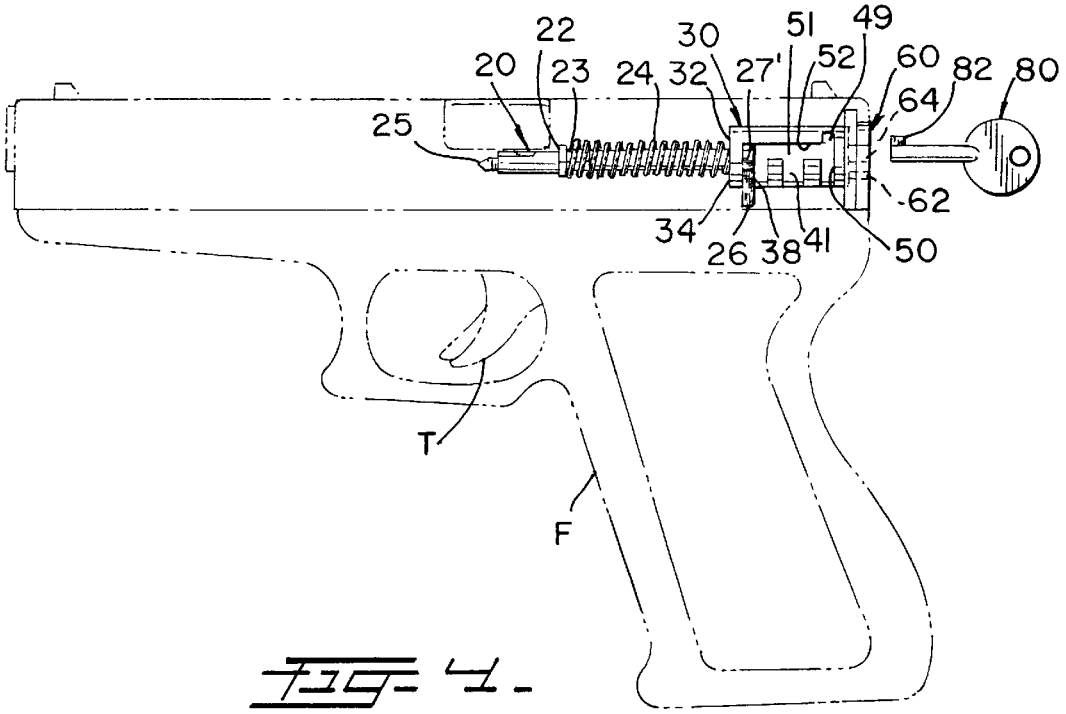
FIG. 4 illustrates an elevational view of a firearm in phantom showing the present invention in the fired and locked position.

As seen in FIG. 4, firearm F is in the fired and locked position. Similar to the sequence performed when placing the firearm in a cocked and locked position, an authorized user utilizes key 80, inserting it into key hole 64 of key plate assembly 60. Key 80 is shaped to cooperatively fit into recess 57, as seen in FIG. 1, of spacer sleeve assembly 30. The user inserts key 80, then turns in a clockwise direction, thereby rotating spacer sleeve assembly 30 to a locked mode position wherefore firing pin assembly leg 26 rests in fired notch 35, upon side edge 36, seen in FIG. 1, between front edge 34 and rear edge 38, thereby preventing the movement of firing pin assembly 20 when activated by trigger T of firearm F. To remove key 80, seen in FIG. 1, the user turns the key in a counter-clockwise direction until key end 82 is aligned with key hole 64 and removed. The user may acknowledge the locked position of firearm F, by viewing indicator 59 through through-hole 62 as seen in FIG. 2*b*.

Figure 5:
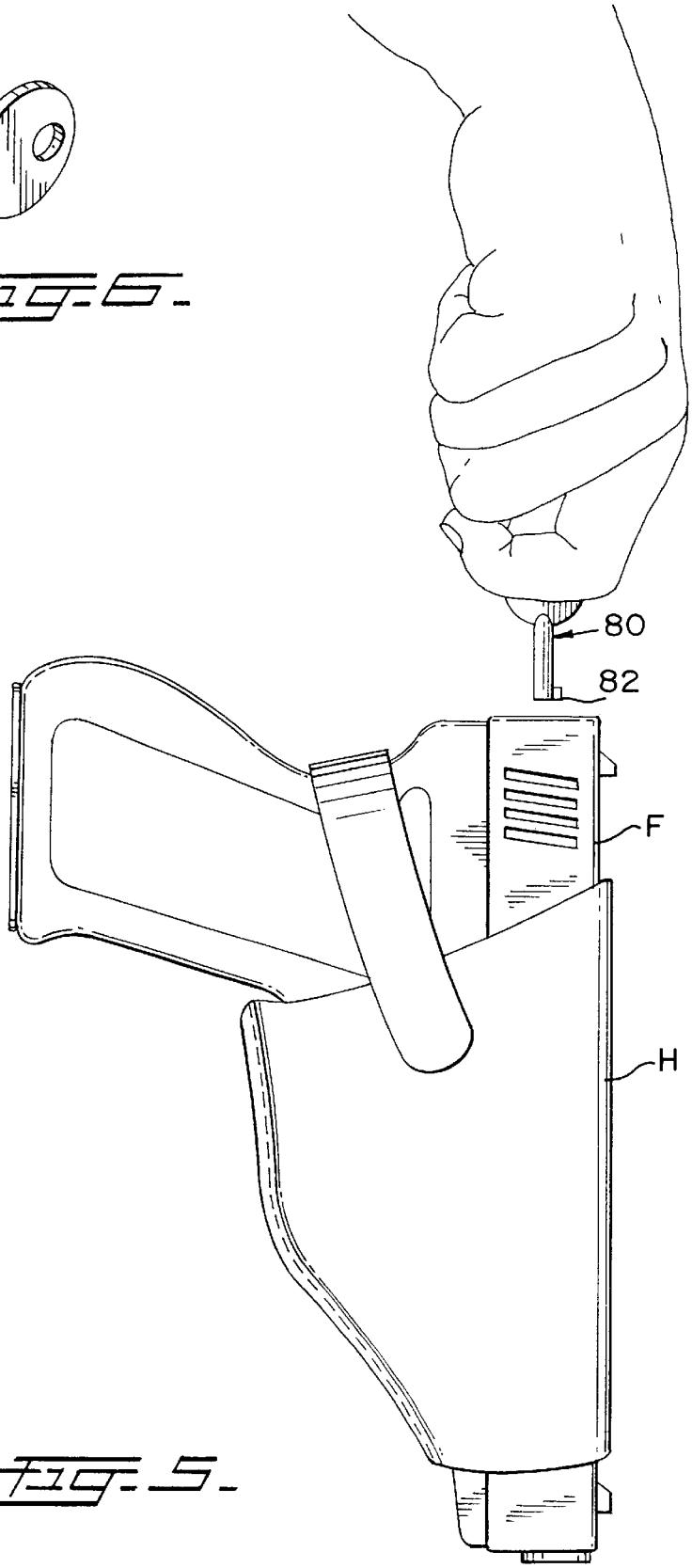
FIG. 5 illustrates an elevational view of a firearm in a holster.

As seen in FIG. 5, firearm F is set in holster H. Without removing firearm F from holster H, the authorized user may place firearm F in an unlocked or locked mode.

Figure 6:
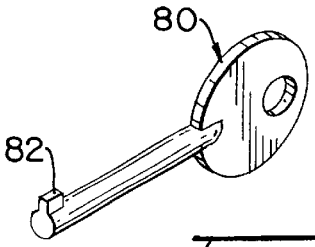
FIG. 6 illustrates a perspective view of a key.

As seen in FIG. 6, key 80 has key end 82. Key end 82 may be of any shape or design to complement recess 57 of spacer sleeve assembly 30 shown in FIG. 1.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. An internal locking mechanism for firearms having an enclosed striker assembly, comprising:

A) a spacer sleeve assembly having first and second ends, between said first and second end a longitudinal channel, said longitudinal channel extending from a first predetermined distance from said first end towards said second end a second predetermined distance without reaching said second end, said longitudinal channel having third and fourth ends, includes a first notch closest to said third end, a second notch located at a third predetermined distance from said third end, and a third notch closest to said fourth end, said first end including a first recess;

B) a firing pin assembly having a shaft with fifth and sixth ends, said fifth end having a leg extending radially outwardly a fourth predetermined distance and said sixth end including a firing pin, said firing pin assembly further includes a stopper surface mounted at a fifth predetermined distance from said fifth end without reaching said sixth end and a spring member partially housing said shaft, said spring member includes seventh and eighth ends, said seventh end coacts against said second end that in turn coacts with said leg, keeping said spring biased towards said second end, said second end having cooperative dimensions to coact with said spring and selectively causing said spring member to compress against said stopper surface;

C) a key plate assembly having inner and outer walls, said key plate having a first through opening, said inner wall including a second recess with mating cooperative characteristics to receive said first end of said spacer sleeve assembly; and D) means for rotating said spacer sleeve assembly through said first through opening so that said leg is selectively brought in alignment with said second or third notch thereby restricting the travel of said shaft, and in alignment with said longitudinal channel having unobstructed travel that permits the operation of said firearm.

2. The internal locking mechanism for firearms having an enclosed striker assembly set forth in claim 1, wherein said means includes a key, insertable through said first through opening of said key plate to said first recess so that a user exerting an inwardly and rotational force, rotates said spacer sleeve assembly selectively from an unlocked mode to a cocked and locked or fired and locked mode and vice-a-versa.

3. The internal locking mechanism for firearms having an enclosed striker assembly set forth in claim 2, wherein said first end of said spacer sleeve assembly has at least one indicating mark.

4. The internal locking mechanism for firearms having an enclosed striker assembly set forth in claim 3, wherein said key plate assembly has a second through opening to allow for visual identification of said indicating mark.

5. The internal locking mechanism for firearms having an enclosed striker assembly set forth in claim 2, wherein said second recess has at least one protrusion axially mounted thereon having mating cooperative characteristics with said first recess to provide notice when said user rotates said spacer sleeve assembly selectively from an unlocked mode to a cocked and locked or fired and locked mode and vice-a-versa.

6. The internal locking mechanism for firearms having an enclosed striker assembly set forth in claim 2, wherein said firearm may be placed locked or unlocked mode while in a holster regardless of whether said firearm is in a cocked or fired position.

* * * * *